United States Patent [19]

Haygreen

[11] Patent Number: 4,630,535

[45] Date of Patent: Dec. 23, 1986

[54] METHOD AND APPARATUS FOR DE-WATERING BIOMASS MATERIALS IN A COMPRESSION DRYING PROCESS

[75] Inventor: John G. Haygreen, Roseville, Minn.

[73] Assignee: Regents of the University of Minnesota, Minneapolis, Minn.

[21] Appl. No.: 660,066

[22] Filed: Oct. 12, 1984

[51] Int. Cl.[4] ..... B30B 9/06

[52] U.S. Cl. ..... 100/127; 100/116; 100/218; 100/295

[58] Field of Search ..... 100/295, 249, 116, 126, 100/127, 128, 129, 218

[56] References Cited

U.S. PATENT DOCUMENTS

| | | | |
|---|---|---|---|
| 184,667 | 11/1876 | Salisbury | 100/128 |
| 653,597 | 7/1900 | Thoens | 100/295 |
| 2,181,674 | 11/1939 | Truesdale | 100/37 |
| 2,622,510 | 12/1952 | Letts | 100/295 X |
| 2,800,072 | 7/1957 | Vandenburgh | 100/127 |
| 2,985,909 | 5/1961 | Smith et al. | 84/144 |
| 3,168,033 | 2/1965 | Hansen | 100/116 X |
| 3,683,795 | 8/1972 | Harris | 100/53 |
| 3,791,289 | 2/1974 | Lamorte et al. | 100/179 |
| 3,838,635 | 10/1974 | Hardy | 100/215 |
| 3,903,790 | 9/1975 | Gladwin | 100/295 X |
| 3,991,670 | 11/1976 | Stromberg | 100/295 |
| 4,019,984 | 4/1977 | Mohn | 210/770 |
| 4,036,359 | 7/1977 | Strickland, Jr. | 206/83.5 |
| 4,047,872 | 9/1977 | Karlsson | 425/469 |
| 4,102,259 | 7/1978 | Thompson et al. | 100/127 X |
| 4,303,412 | 11/1981 | Baikoff | 44/1 D |
| 4,343,233 | 8/1982 | Burgin | 100/116 |
| 4,393,767 | 7/1983 | Dutfield | 100/295 |

*Primary Examiner*—Peter Feldman

*Attorney, Agent, or Firm*—Orrin M. Haugen; Thomas J. Nikolai; Frederick W. Niebuhr

[57] ABSTRACT

A method and apparatus for more effectively squeezing moisture from wood chips and/or other "green" biomass materials. A press comprising a generally closed chamber having a laterally movable base at the lower end thereof, and a piston or ram conforming in shape to the cross-section of the chamber is adapted to periodically receive a charge of biomass material to be dehydrated. The ram is forced against the biomass material with suffcient force to compress the biomass and to crush the matrix in which moisture is contained within the material with the face of the ram being configured to cause a preferential flow of moisture from the center of the mass outwardly to the grooved walls of the chamber. Thus, the moisture is effectively squeezed from the biomass and flows through the grooves formed in the walls of the chamber to a collecting receptacle and is not drawn back into the mass by capillary action when the force is removed from the ram.

8 Claims, 7 Drawing Figures

METHOD AND APPARATUS FOR DE-WATERING BIOMASS MATERIALS IN A COMPRESSION DRYING PROCESS

BACKGROUND OF THE INVENTION

I. Field of the Invention

This invention relates generally to a method and apparatus for dehydrating "green" bio-materials, such as freshly cut wood chips, and more specifically to an improved baling press whereby an increased water movement from the center of the biomass to the edges thereof is achieved.

II. Discussion of the Prior Art

In preparing biomass material, such as wood chips, for later use as an industrial fuel, it is generally desirable that the moisture content of the fuel be reduced as much as is practical, given the amount of energy which is expended in carrying out the drying process.

It is known in the art that wood chips may be mechanically dewatered by passing the "green" wood chips through roll or nip presses. Such presses are less than satisfactory from an efficiency standpoint in that they are able to reduce the moisture content of wood chips and bark residues to only about 100 percent on a dry-weight basis. By definition, a 100 percent moisture content means that the weight of the water in the wood chips is equal to the weight of the dry wood itself. In that many woody biomass materials harvested for use as fuels are only slightly wetter than this 100 percent moisture content (MC) immediately upon harvesting, the use of roll or nip presses cannot be economically justified.

In papers which I published in the *Forest Products Journal* (Volume 31, No. 8 and Volume 32, No. 10) it was reported that by using a batch-type baling press it appeared feasible to reduce the moisture content of green wood chips to about 55 percent. That estimate, which was based upon experimental work involving a laboratory-scale baling press, incorporated an enclosed chamber having a laterally-movable bottom member and a hydraulically-operated ram for squeezing a charge of green wood chips against that movable bottom member, utilizing a flat ram face which results in a practically zero pressure gradient being built up across the pressure chamber as the ram is folded downward on the biomass charge.

The Strickland U.S. Pat. No. 4,036,359 describes a baling press arrangement for de-watering wood chips, but it, too, describes a ram face configuration which is flat or planar. The application of high pressure alone is not sufficient to ensure effective compression drying of biomass materials. No matter what type of mechanical system is employed, it is important that a means be provided for removing the expelled water from contact with the mat of compressed biomaterials prior to the release of the pressure. Otherwise, upon release of the pressure, the compressed biomass materials would tend to expand and, if the expelled water is still in contact with the biomass, it would be drawn into the material.

The necessity of removing the water from contact with the biomass while it is still under pressure led me to conclude that certain mechanisms for applying pressure may be more effective than others.

I have theorized that if a substantial pressure gradient can be established within the compressed biomass mat immediately upon closing the press, an increase in the rate of water removal as well as the extent of removal can be enhanced. To my knowledge, while several attempts have been made to de-water wood chips in a baling press, each case a flat ram face has been used. No one, to my knowledge, has attempted to improve the efficiency of the de-watering process through modification of the shape of the ram face in a fashion to increase the establishment of a desired pressure gradient.

OBJECTS

It is accordingly a principal object of the present invention to provide a new and improved apparatus for de-watering biomass materials.

Another object of the invention is to provide a baling press apparatus for the batch dehydration of moisture-containing wood chips.

Another object of the invention is to provide in a baling press in which green wood chips are to be dryed, a ram configuration for enhancing the outward flow of moisture from the biomass charge.

Still another object of the invention is to provide in a baling press, a ram whose working face is profiled so as to create a pressure gradient across a biomass being squeezed to thereby induce the flow of moisture preferentially to the side walls of the press.

SUMMARY OF THE INVENTION

These and other objects and advantages of the invention result from the provision in a baling press of the type including a movable ram disposed within a chamber having side walls conforming generally to the cross-section of the ram, the face of the ram being provided with a non-planar stepped profile. When a charge of biomass material, e.g., green wood chips, is placed within the chamber and the ram is forced against such charge by the application of appropriate hydraulic forces, a pressure gradient in the biomass mat is created causing a preferential flow of water from the center of the mat outward to said peripheral edges. Here, grooves formed in the side walls of the chamber provide a liquid flow path to a suitable collection device. Following the application of the pressing force by the ram against the biomass and the removal of moisture therefrom, the resulting compressed mass may be removed from the chamber through a laterally movable base of the chamber.

Having summarized the basic features of the invention, a further explanation of the details of the construction and mode of operation of a preferred embodiment of the invention will next be set forth. In this regard, attention will be directed to the drawings in which like numerals in the several views refer to corresponding parts.

DESCRIPTION OF THE PREFERRED EMBODIMENT

Figure 1:
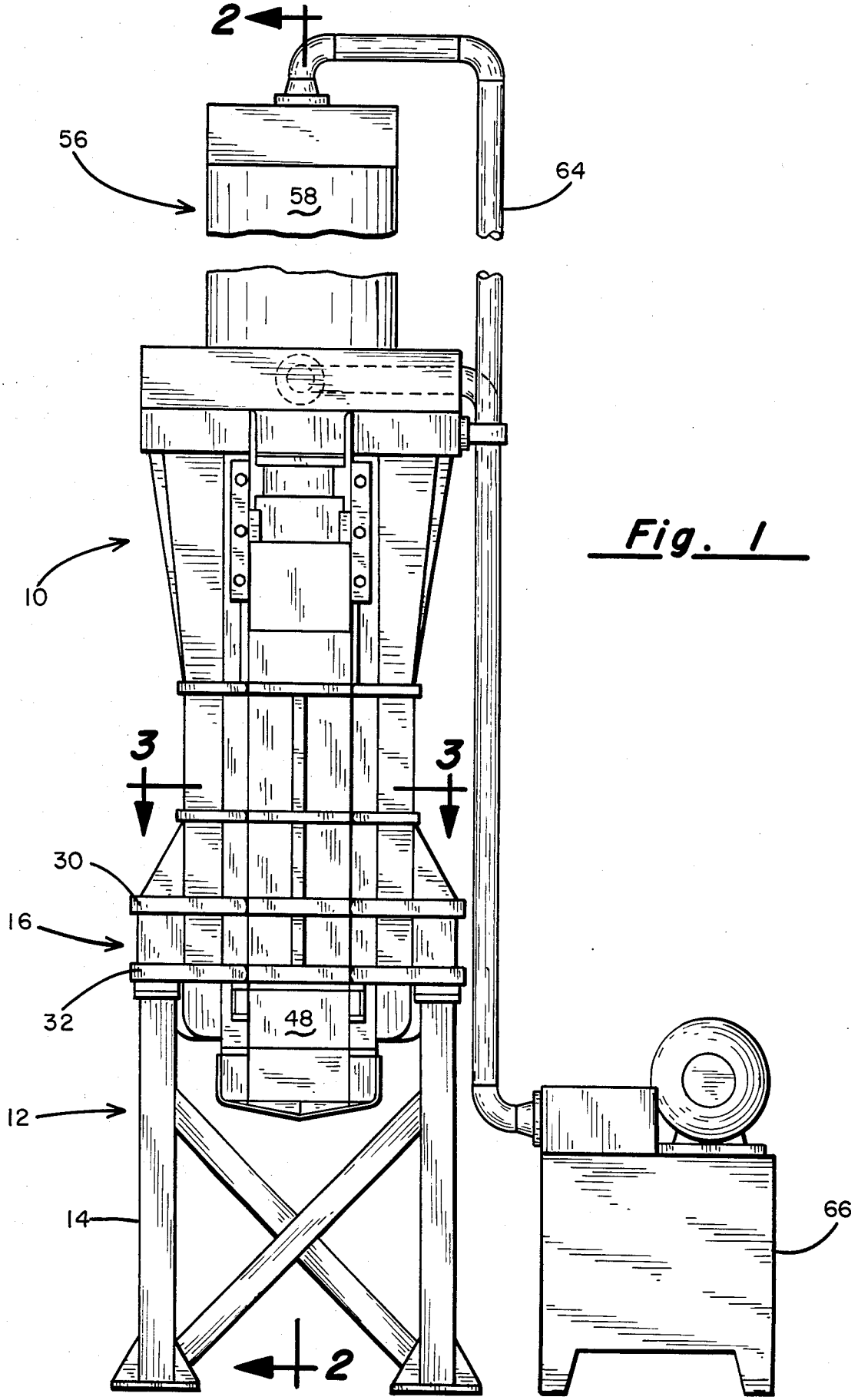
FIG. 1 is a side elevation of a baling press incorporating the present invention.

At the outset, it should be mentioned that certain terminology will be used in the following description for convenience in reference only and should not be considered as limiting of the invention. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. This terminology is intended to include the words specifically mentioned above as well as derivatives thereof and words of similar import.

Referring to FIG. 1 there is shown a side elevation of a baling press 10 incorporating the present invention. The baling press includes a base or pedestal 12 having four legs, as at 14, for supporting it off of the ground. Bolted or otherwise affixed to the upper end of the legs 14 is a compression chamber indicated generally by numeral 16, which is shown in detail in the cross-sectional views of FIGS. 2 and 3. The chamber 16 is formed by four mutually orthogonal planar, vertically extending steel side plates 18, 20, 22 and 24 which are arranged in pairs in parallel, spaced-apart relationship to one another. The plates 20 and 24 are rabbeted proximate the side edges thereof so that the side plates 18 and 22 may be fitted therein in interlocking fashion, all as can best be seen from the cross-sectional view of FIG. 2. These plates are preferably welded as at 26 to form a rigid, vertically extending rectangular chamber therebetween. Vertical reinforcing bars 28 are disposed along the outer wall surfaces of the chamber defining plates 20–24 and steel bands as at 30 and 32 surround the vertical support bars 28 and cooperate therewith to resist or preclude outward expansion of the vertical chamber defining plates 20–24 when high pressures are applied to the mass of material to be de-watered.

Figure 3:
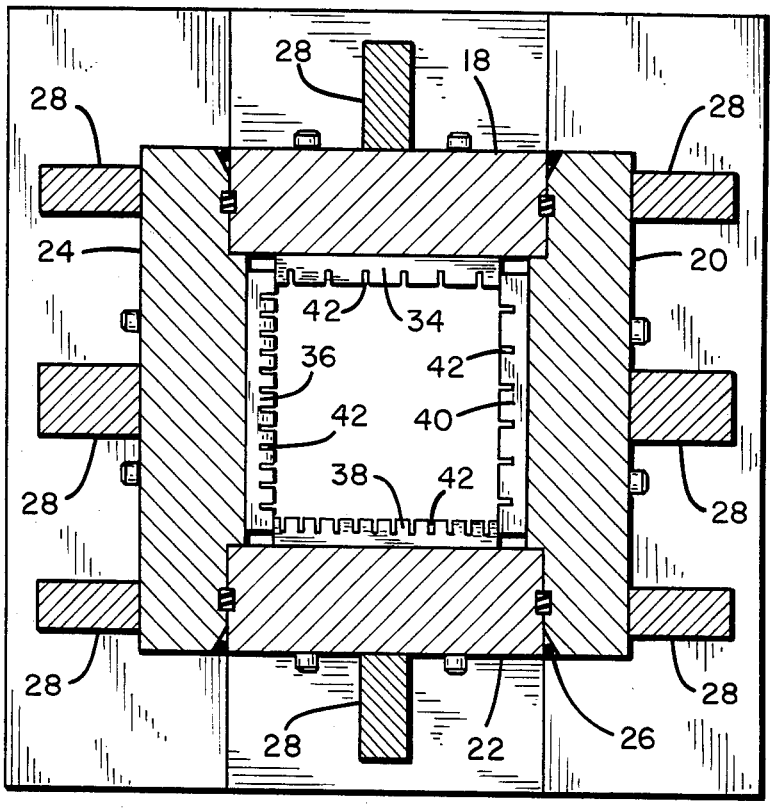
FIG. 3 is a cross-sectional view of the portion of the baling press taking along the line 3—3 in FIG. 1.

As can best be seen in FIG. 3, lining the interior walls defined by the side plates 20–24 are liners 34, 36, 38 and 40, which are bolted or otherwise affixed in place. The liners are provided with spaced-apart, vertically-extending slots which provide a path by which liquids squeezed from the biomass charge may travel under the force of gravity to a liquid catch pan 44 mounted on the underside of the baling chamber 16.

Figure 2:
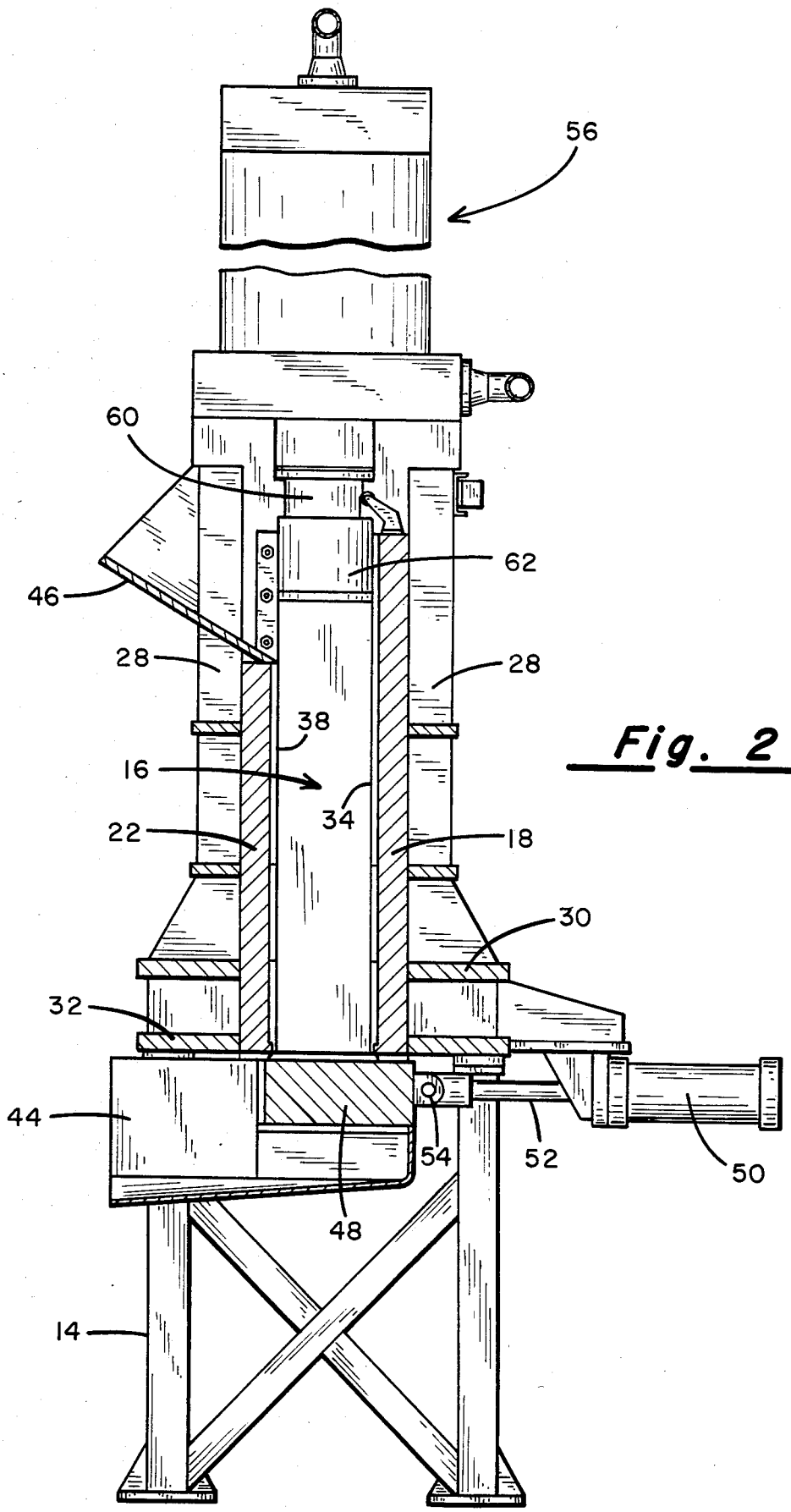
FIG. 2 is a cross-sectional view of the baling press taken along the line 2—2 in FIG. 1.

With reference to FIG. 2, a loading hopper 46 is provided, the hopper leading to the interior of the baling chamber 16. Wood chips or other biomass material fed through the loading hopper 46 will fall to the bottom of the chamber where it is blocked by a laterally movable base member 48. The base plate 48 is adapted to be driven by a hydraulic actuator 50 having a piston arm 52 connected to the base plate 48 by a hinged coupling 54. In this manner, the bottom plate may be moved to allow ejection of the treated biomass.

Resting atop the baling chamber 16 and above the loading hopper 46 is a hydraulic ram assembly, indicated generally by numeral 56. The hydraulic ram includes a cylinder 58 containing a piston (not shown), the piston being coupled through a piston rod 60 to a ram 62 which is appropriately sized to fit in a sliding relationship with respect to the wall liners 34–40. Hydraulic fluid under pressure is applied to the cylinder 58 via tubing 64 from a power unit 66 which typically comprises a motor-driven hydraulic pump.

With no limitation intended and strictly for the purpose of explaining the design of a preferred embodiment, the baling press of the present invention may have a chamber which is square, one foot on a side, the slots 42 in the liners being on one inch centers and being approximately one-eighth inch deep. The cylinder 58 may typically have an 18 inch diameter bore including a 10 inch diameter piston rod allowing a 57 inch travel and developing 720 tons of force at approximately 5,700 pounds per square inch hydraulic pressure. As mentioned, it is not intended that the invention be limited to use with a baling press having a square ram as at 62, it being understood that the same principles may be applied to a baling press having a compression chamber which is circular or polygonal in cross-section.

Figure 4:
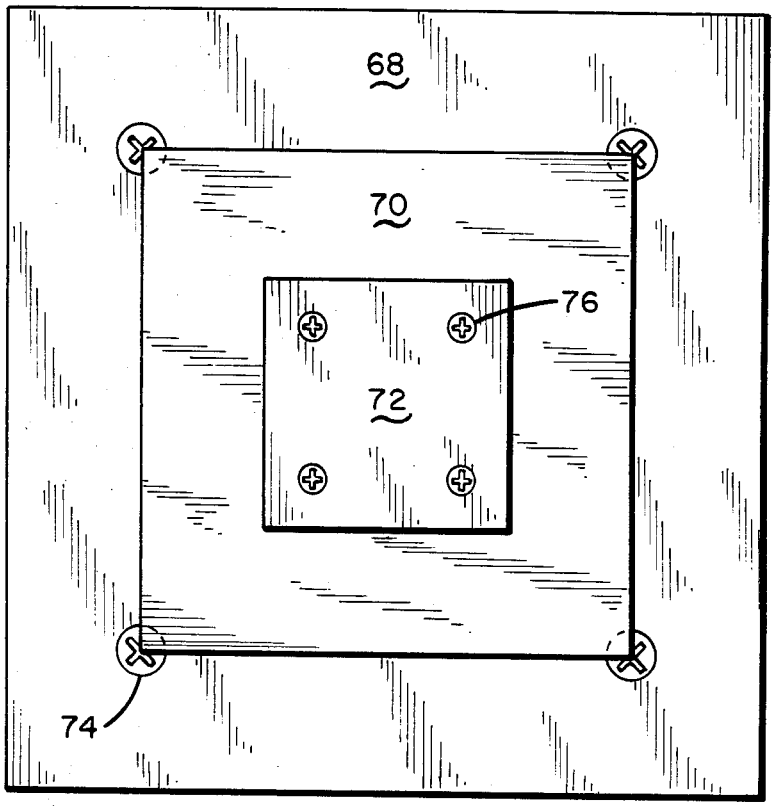
FIG. 4 is a plan view of the working face of the ram used in the baling press of FIG. 1.
Figure 5:
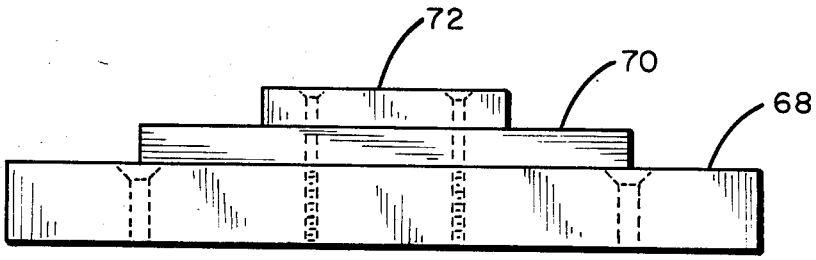
FIG. 5 is a side view of the working face of the ram.

As is set out in my aforereferenced publications in the *Forest Products Journal,* Volume 31, No. 8 and Volume 32, No. 10, baling presses of the type heretofore described have been used for de-watering biomass materials, including green wood chips. My invention, which is about to be described, constitutes an improvement over the just-described apparatus in that in place of a planar working face on the ram 62, I provide a non-planar ram face which is provided with a predetermined stepped, height profile which, whch brought to bear on the biomass material, produces a predetermined pressure gradient so as to induce the flow of moisture from the center of the biomass toward the side walls of the press where the moisture (liquid) may collect in the vertical grooves 42 and travel to the liquid catchpan 44 of the baling press. As is shown in FIGS. 4 and 5, attached to the ram 62 (FIG. 2) are a series of square plates or blocks 68, 70 and 72, which are of decreasing area in going from top to bottom and which are disposed in a stacked, concentric relationship with respect to one another. The base plate 68 attaches directly to the bottom of the ram 62 by means of countersunk flat-head bolts as at 74. The intermediate plate 70 and the lowermost plate 72 are joined to the base plate by flat-head bolts 76.

Figure 6:
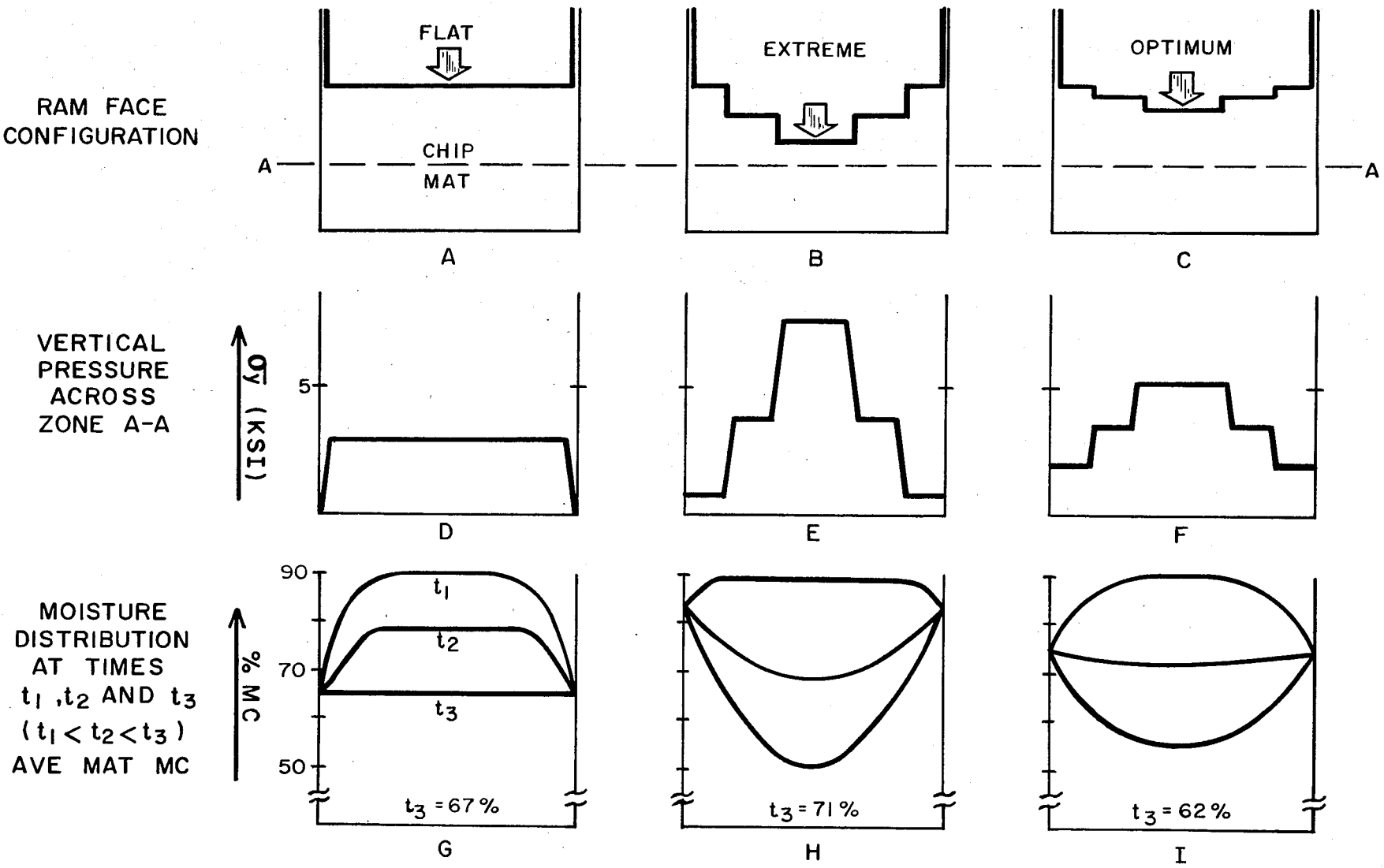
FIG. 6 are a series of curves showing the effect of ram face configuration on the pressure distribution, moisture distribution and final moisture content in a compressed biomass mat.

With reference to FIG. 5, a side elevation of the face plate assembly for the ram 62 is shown. With no limitation intended, when a 12 inch square ram is employed, the plate 68 would also be a 12 inch square and may typically be one inch thick. The plate 70 may then be an 8 inch square approximately ⅜ths inches thick while the plate 72 may be a 4 inch square, also ⅜ths inches thick. The dimensions given should be considered as exemplary only in that variation in tree species from which the woodchips are harvested may dictate changes in thickness and size of the plates 70 and 72 to achieve a desired pressure gradient for enhancing flow of moisture from the center of the biomass to the grooved side walls of the baling press. Further, the height of the uncompressed chip mat, which is determined by the specific press design, will affect the optimum size of plates 70 and 72. The concepts underlying the present invention can be appreciated with reference to the curves of FIG. 6 which show the effect of the ram face configuration on the pressure distribution, the moisture distribution and the final moisture content of the biomass being treated in the compression drying pressure chamber heretofore described. With reference to the curves of FIGS. 6A, 6D and 6G, when a baling press with a planar ram working face is employed, the vertical pressure across the width of the biomass charge is nearly uniform (FIG. 1D). As such, water movement is initiated at the peripheral edges of the baling press and propagates inwardly, as reflected in the curves of FIG. 6G. Eventually, after a predetermined time has elapsed in which the pressure has been continuously applied (time $t_3$), the moisture content of the mass is reduced uniformly across it.

The curves of FIGS. 6B, 6E and 6H show that if a non-planar ram face configuration is used that provides a steep profile across the ram face, a very steep pressure gradient is immediately developed toward the center of the mat (FIG. 6E). Water removal from the center of the mat is quite efficient, but the pressure outwardly of the center segment of the profile face never reaches a stress value sufficiently high to effectively expel water in the region surrounding the center of the mat. Stated somewhat differently, considering a press having a ram with the profile shown in FIG. 6B, as the ram descends, it compacts the mass highly in the central portion, but because of the extreme height profile of the steps, there is a reduced compression force in the outer peripheral zone such that the pressure never reaches a stress sufficiently high for the moisture to be forced to the periphery of the chamber and effectively be expelled from the biomass in that region. Thus, at the end of the pressing cycle (FIG. 6H), the wood chips in the outer portion of the cell are only slightly drier than at the beginning of the cycle and the average moisture content of the mat remains higher than if a planar ram face configuration (FIG. 6A) had been used.

By properly designing the face profile of the ram, however, an optimum configuration can be achieved whereby a pressure gradient is developed across the biomass mat, which is adequate to remove the water from the center of the cell while still developing sufficient pressure to expel that water from the outer regions of the cell as well. With reference to FIGS. 6C, 6F and 6I, where the step profile is not as extreme as in FIG. 6B, the pressure gradient is also less severe and the final average moisture content of the wood chips being treated is less than what was achieved using either the flat ram profile (FIG. 6A) or the extreme profile (FIG. 6D).

Figure 7:
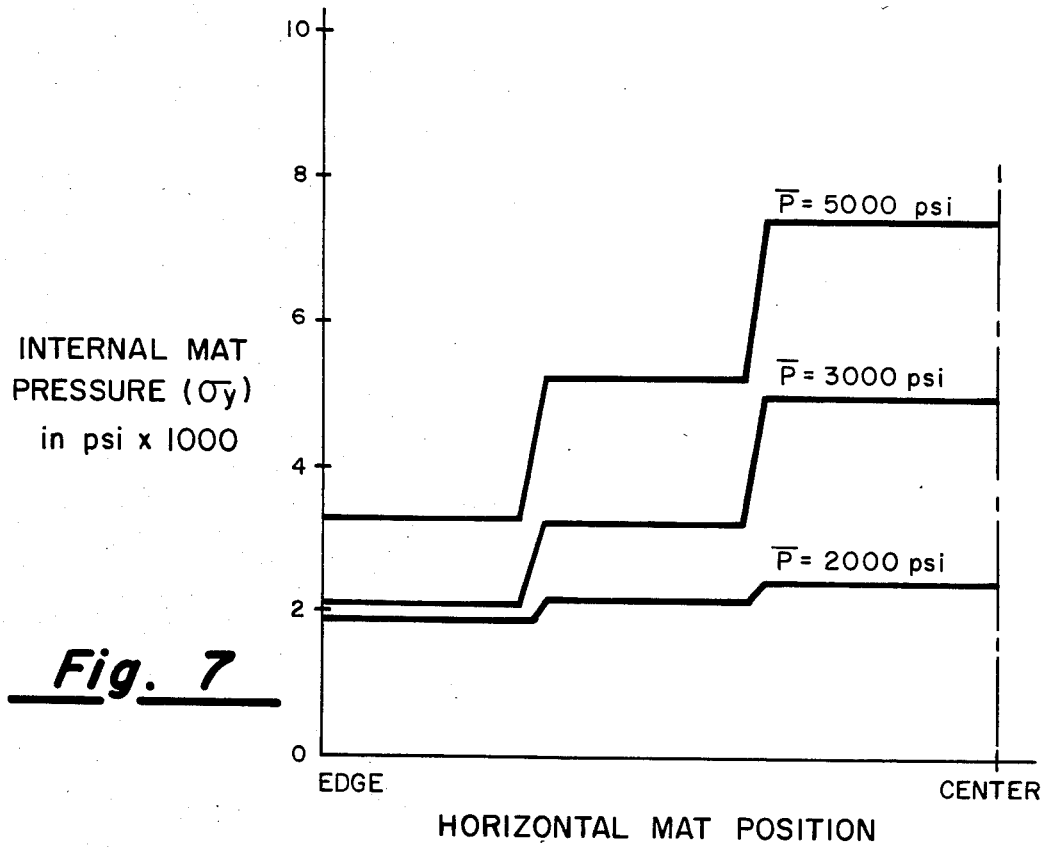
FIG. 7 depicts a graph showing the change in internal mat pressure as average ram face pressure is increased from 2000 psi to 5000 psi when the preferred ram face configuration of the present invention is utilized.

The curves of FIG. 7 illustrate the manner in which the stress distribution will develop in a wood chip mat as the average ram face pressure is increased from 2000 to 5000 psi when a stepped ram face configuration such as shown in FIGS. 4 and 5 is utilized. In this example, there is about a 4000 psi pressure gradient between the center of the baling chamber and the water venting slots formed in the chamber sideliners. Nonetheless, a stress of about 3300 psi exists at the edge of the mat and is adequate for effective de-watering of that segment of the mat.

I have determined empirically that the basic stress levels and stress gradients necessary for efficient de-watering of green wood chips varies depending upon the particular species of wood and the particle size of the chip. However, generally speaking, the pressure at the outer zones of the cell are preferably in the range of from 2000 to 4000 psi with the pressure gradient to the center being in the range of from 1500 to 4000 psi. Thus, the optimum pressure at the center of the mat should be from 3500 to 8000 psi.

As was already mentioned, the means of obtaining this pressure gradient was by appropriately contouring the face of the ram with a series of flat zones. The face of the ram may be round or square with the "steps" shaped accordingly. While other shapes or profiles, such as a truncated cone, would provide some pressure gradient, the horizontal component of the vertical ram force would increase the lateral pressure, thereby reducing the effectiveness of the system. Thus, a series of flat steps, such as shown in FIGS. 4 and 5, have been found to be the shape that provides the most effective means for developing the desired pressure gradient.

The height of the steps should be designed in accordance with the diameter or square dimension of the ram face, the thickness of the biomass mat at the desired pressure, the extent of compaction of the mat to increase the pressure an amount equivalent to the desired pressure gradient and the species of wood and size of chip. It is also these factors which determine the pressure gradient which is optimum for lateral moisture flow through the mat.

The compaction required to obtain the optimum pressure gradient may be determined either from laboratory-scale tests or by load-deformation data from mats in the commercial press in which the ram face configuration (RFC) is to be used. In either case, what must be determined is the stress-strain (load-deformation) relationship of the compressed mat at the desired average ram face pressure. The total height of the steps is then equal to the mat height of the average ram face pressure times the desired pressure gradient (1500 to 4000 psi) divided by the stress-strain ratio at the average pressure.

The following table reflects experimental results at two average ram face pressures for large chips and small chips and also shows the percent improvement in the amount of water removed during the process when using the optimum ram face configuration as compared to a flat ram face configuration. (See FIG. 6.) Prior to treatment, the wood chips had a moisture content of 91% measured on a dry basis. On a dry basis, the amount of water in wood is expressed as a percent of the weight of oven-dried wood.

TABLE I

| Ram Face Configuration | Average Ram Face Pressure | | | |
|---|---|---|---|---|
| | 3000 PSI | | 5000 PSI | |
| | Large Chip | Small Chip | Large Chip | Small Chip |
| | Final Moisture Content (%) | | | |
| Flat | 71 | 66 | 65 | 62 |
| Extreme | 75 | 72 | 65 | 62 |
| Optimum | 65 | 61 | 60 | 56 |
| % Improvement of Optimum RFC versus Flat RFC | 30% | 20% | 19% | 21% |

In comparing the percent improvement in moisture removal when the optimum, RFC is employed rather than a flat configuration, there is shown a 30% improvement with large chips and with the 3000 psi pressure applied. The test fixture in which the data of the above table was run had a circular ram 5½ inches in diameter and the optimum ram face configuration involved two steps, each 0.12 inches high.

Thus, it can be seen that by properly configuring the face of the ram used in a baling press, the amount of moisture removal from a green biomass is markedly improved over what can be accomplished using a planar ram face. While a preferred embodiment of the invention has been shown and described, it is to be understood that various modifications and changes may be made to the preferred embodiment without departing from the spirit and scope of the invention. Accordingly, it is intended that the scope of the invention be determined by the following claims:

I claim:

1. Apparatus for reducing the moisture content of biomass material comprising:

an enclosed chamber having generally vertical side walls and a base forming the bottom of said chamber and movable with respect to said side walls;

means for loading moisture ladened biomass material into said chamber;

a vertically reciprocable ram having a working face opposed to said movable base, and disposed in said chamber in slidable relationship to said vertical side walls;

a conduit means elongate in the generally vertical direction along said side walls for conducting moisture removed from said biomass material out of said chamber;

means for applying a predetermined force on said ram for pressing said biomass material against said base; and means forming a select, non-planar profile in said working face, for developing and sustaining a selected pressure gradient across said biomass material as said ram presses thereagainst; said profile converging toward said base and characterized by a plurality of discrete, substantially horizontal stepped portions, and a vertical stepped portion joined with each pair of adjacent horizontal portions; said gradient characterized by a maximum pressure at the center of said chamber diminishing to a minimum pressure near said side walls to drive moisture radially outward from said center, yet provide a minimum pressure sufficiently large to expel moisture out of said chamber through said conduit means; thus to enhance the amount of moisture expelled from said biomass material and chamber as said ram presses against said material.

2. The apparatus as in claim 1 wherein said conduit means include a plurality of vertically extending liquid transporting grooves formed into the interior surface of the vertical side walls.

3. The apparatus as in claim 1 wherein said means forming a non-planar profile in the working face include a plurality of discrete, substantially flat plates in stacked relation on said ram.

4. The apparatus as in claim 1 wherein the working face of said ram engaging the biomass comprises a plurality of discrete three-dimensional segments, each of the same horizontal cross-sectional shape as the horizontal cross-sectional shape of said chamber but of decreasing cross-sectional area in the direction toward said base, said segments being disposed in a concentric stacked relationship.

5. The apparatus as in claim 4 wherein said segments have a generally polygonal cross-section.

6. The apparatus as in claim 4 wherein said segments have a generally square cross-section.

7. The apparatus as in claim 4 wherein said segments have a round cross-section.

8. A method for de-watering biomass material comprising the steps of:

(a) feeding said biomass material in batches into a baling chamber; and (b) forcing a compaction ram against a batch of said biomass material, said ram having a non-planar working face engaging said batch of biomass material, said working face having a profile converging toward said batch and characterized by a plurality of discrete, substantially horizontal stepped portions, and a vertical stepped portion joined with each pair of adjacent horizontal step portions and being shaped to create a predetermined negative pressure gradient from the center of said batch toward the walls of said baling chamber, said gradient being sufficiently steep for driving the moisture radially outward from said center, yet providing a pressure at said walls sufficient to expel moisture out of said chamber, thereby enhancing the flow of moisture from said batch to the walls and out of said baling chamber through a conduit means elongate generally in the direction of ram movement along said walls.

* * * * *

UNITED STATES PATENT AND TRADEMARK OFFICE

CERTIFICATE OF CORRECTION

PATENT NO. : 4,630,535

DATED : December 23, 1986

INVENTOR(S) : John G. Haygreen

It is certified that error appears in the above-identified patent and that said Letters Patent is hereby corrected as shown below:

Column 8, Line 33, "negative" should be deleted.

Column 8, Line 36, "the" should read -- of --.

Signed and Sealed this

Tenth Day of March, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,630,535

DATED : December 23, 1986

INVENTOR(S) : John G. Haygreen

It is certified that error appears in the above-identified patent and that said Letters Patent is hereby corrected as shown below:

Column 1, Line 13, after "thereof is achieved.", the following should be inserted -- This invention was made with Government support under contract DE-AS07-83ID 12349 awarded by the Department of Energy. The Government has certain rights in this invention. --

Signed and Sealed this

Twelfth Day of January, 1988

*Attest:*

DONALD J. QUIGG

*Attesting Officer*

*Commissioner of Patents and Trademarks*